United States Patent [19]

Freeman et al.

[11] 4,080,779

[45] Mar. 28, 1978

[54] PRODUCTION OF PLIED YARN

[76] Inventors: James Edward Freeman, 35 Gibson Ave., Norden, Rochdale; Arthur Francis Bagnall, 5 Gresham Close, Whitefield, Manchester, both of England; John McKenzie, deceased, late of Manchester, England; by Marion McKenzie, legal representative, 20 Wingate Drive, Whitefield, Manchester, England

[21] Appl. No.: 710,327

[22] Filed: Jul. 30, 1976

[30] Foreign Application Priority Data

Aug. 1, 1975 United Kingdom ..... 32161/75

[51] Int. Cl.[2] ..... D01H 1/08; D02G 3/38

[52] U.S. Cl. ..... 57/160; 57/18; 57/34 CP

[58] Field of Search ..... 57/3, 18, 34 CP, 76, 57/156, 160, 58.95, 90

[56] References Cited

U.S. PATENT DOCUMENTS

| | | | |
|---|---|---|---|
| 2,986,868 | 6/1961 | Tallis et al. | 57/160 X |
| 3,733,799 | 5/1973 | Roethke | 57/58.95 |
| 3,834,150 | 9/1974 | Ohewel | 57/156 |

FOREIGN PATENT DOCUMENTS

| | | | |
|---|---|---|---|
| 11,182 | 5/1969 | Japan | 57/160 |
| 85,832 | 1973 | Japan | 57/160 |

*Primary Examiner*—Richard C. Queisser
*Assistant Examiner*—Charles Gorenstein
*Attorney, Agent, or Firm*—Fleit & Jacobson

[57] ABSTRACT

The production of plied yarn in pot spinning in which a pot is filled with yarn emerging in one direction from a reciprocating traversing tube. When the pot is filled to the desired extent a lead yarn is injected into the pot by pneumatic means in a direction opposite to the said one direction so that yarn from the traversing tube is wound around the lead yarn. The lead yarn is then withdrawn from the pot in said one direction and the yarn in the pot is wound around further yarn from the traversing tube.

1 Claim, 2 Drawing Figures

PRODUCTION OF PLIED YARN

This invention relates to the production of plied yarn in a pot spinning machine.

It has already been proposed to ply yarns in a pot spinning machine. According to such known method, yarn is delivered into a spinning pot through the end of a traverse tube which reciprocates along the axis of the pot. When the pot is sufficiently full, the yarn from the traverse tube is drawn out of the bottom of the pot and led to take-up means. As further yarn is drawn from the traverse tube it is twisted with the yarn which is simultaneously drawn out of the pot.

The normal procedure for changing from singles spinning (i.e. filling the pot) to plying is accomplished by manually inserting a long handled hook or probe through the bottom of the pot. The hook or probe is engaged on the yarn issuing from the traverse tube and then withdrawn. This is a time consuming and dangerous operaton. Moreover, it is extremely difficult to synchronise, by this means, the withdrawal of the yarn from the bottom of the pot with the operaton of the pot spinning machine as a whole and that leads to faults which develop inside the spinning pot.

The present invention has been made from a consideraton of these points.

Figure 1:
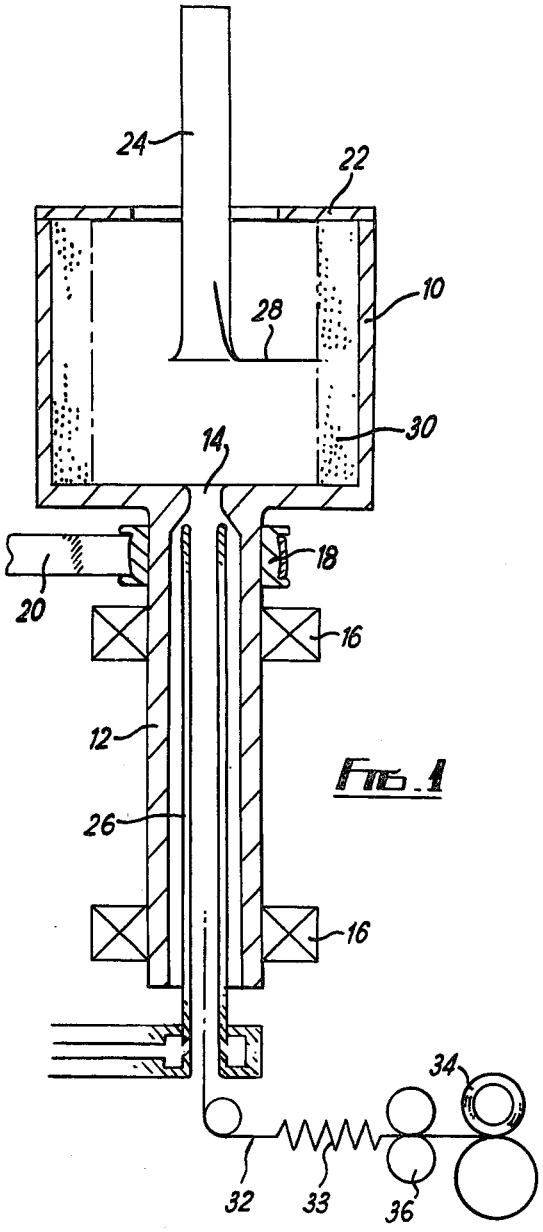
Figure 2:
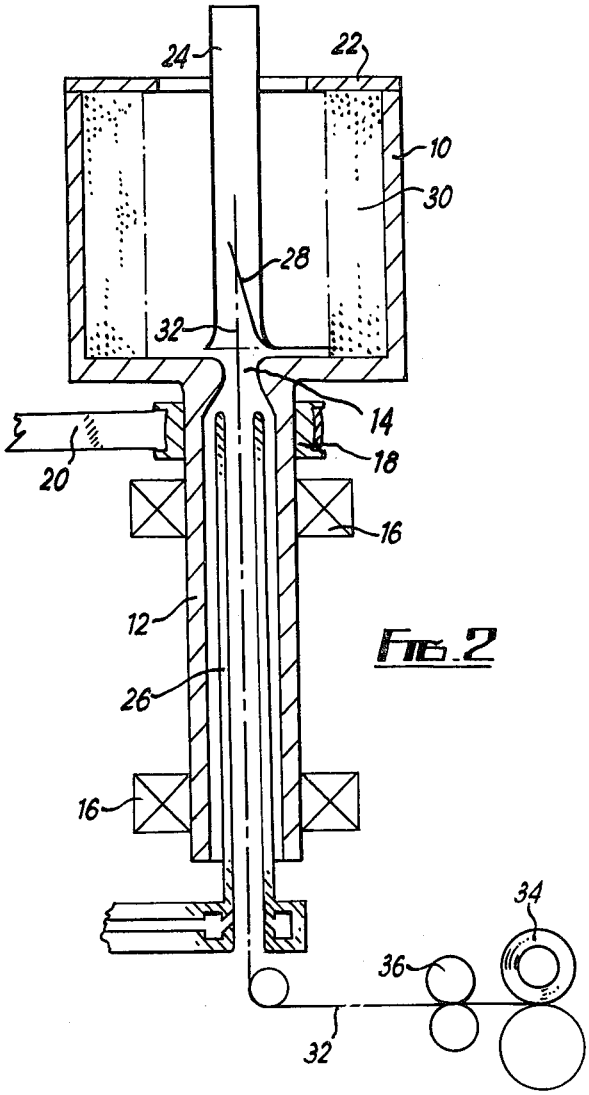

According to the present invention there is provided a method of producing a plied yarn in a pot spinning machine having a spinning pot and a traversing tube coaxial with said pot, said method comprising filling the spinning pot to a predetermined capacity with yarn delivered from the traversing tube while said traversing tube is reciprocated along the axis of said pot, injecting a lead yarn into said pot so that the yarn being delivered from the traversing tube is wound around said lead yarn and drawing the lead yarn out of the pot together with yarn from said traversing tube, whereby yarn in said pot is wound around yarn led from said traversng tube. A specific embodiment of the invention will now be described by way of example with reference to the accompanying drawing, in which:

FIG. 1 shows diagrammatically and partly in section a part of a pot spinning machine during filling of the pot; and FIG. 2 shows the arrangement of FIG. 1 during insertion of lead yarn. Referring to FIG. 1, a spinning pot 10 in the form of a hollow open topped cylindrical body, has a tubular extension 12 projecting from the bottom of the pot. The tubular extension 12 is co-axially aligned with the pot and with an aperture 14 formed in the centre of the bottom of the pot. The pot is mounted for rotation about a vertical axis by virtue of bearings 16 into which the tubular extension is journalled. A pulley 18 is fixed to the tubular extension and the pot is rotated by means of a belt 20 between the pulley and drive means (not shown). The top of the pot is partially closed by an annular cap 22 which gives sufficient access for a traversing tube 24 to be reciprocated axially within the pot.

A pneumatic injector 26 is positioned in the tubular extension. The injector is directed upwardly and is co-axial with the pot.

In operaton, yarn 28 is led downwardly through the reciprocating traversing tube and, by virtue of centrifugal force created by the rotation of the pot, is accummulated on the inner cylindrical wall of the pot as at 30. While the pot is being thus filled, a length of yarn 32 is unwound from a package 34 and led through a yarn storage unit 33 to the pneumatic injector 26.

When the pot has been filled to the desired capacity and when the traversing tube is at its lowest position, i.e. as shown in FIG. 2, the injector is operated and the length of yarn or lead yarn 32 is injected through the bottom of the pot. The length of lead yarn taken off the package is chosen such that the end of the lead yarn will, when injected, project into the lower portion of the traversing tube.

As will be evident from the foregoing, the centrifugal force applied to yarn 28 leaving the traversing tube causes the said yarn 28 in the lower part of the traversing tube to follow a path which is inclined to the axis of the pot. In other words, as the pot rotates the yarn 28 at the bottom part of the traversing tube revolves around a cone. Now the end of the injected lead yarn 32 lies on the axis and, therefore, the yarn 28 is wound around the said end of the lead yarn causing the yarn 28 and yarn 32 to be connected together.

The yarn 32 is now rewound on the package 34, thus drawing the yarn 28 from the pot. As with known methods, the removal of the yarn 28 causes yarn in the pot to be wound around further yarn issuing from the traversing tube so that a plied yarn is produced. The correct synchronisation of the speed of removal of the yarn from the pot is achieved by the general yarn line and the nip of haul-off rollers 36.

What we claim is:

1. In a method wherein piled yarn is produced in a pot spinning machine having a spinning pot and a traversing tube coaxial with said pot, the improvement consisting of the steps of filling the spinning pot to a predetermined capacity with yarn delivered from the traversing tube while said traversing tube is reciprocating along the axis of said pot; injecting a lead yarn by fluid jet means into said pot so that the yarn being delivered from the traversing tube is wound around said lead yarn and, drawing the lead yarn out of the pot together with yarn from said traversing tube whereby yarn in said pot is wound around yarn led from said traversing tube, said lead yarn being injected through the bottom of the pot in a direction opposite to the direction of travel of yarn into and through the traversing tube when the traversing tube is in the lower part of the pot.

* * * * *